US006626718B2

(12) United States Patent
Hiroki

(10) Patent No.: US 6,626,718 B2
(45) Date of Patent: Sep. 30, 2003

(54) APPARATUS FOR MANUFACTURING ELECTRON SOURCE, METHOD FOR MANUFACTURING ELECTRON SOURCE, AND METHOD FOR MANUFACTURING IMAGE-FORMING APPARATUS

(75) Inventor: Tamayo Hiroki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 145 days.

(21) Appl. No.: 09/954,072

(22) Filed: Sep. 18, 2001

(65) Prior Publication Data

US 2002/0042238 A1 Apr. 11, 2002

(30) Foreign Application Priority Data

Oct. 3, 2000 (JP) ..... 2000-304068

(51) Int. Cl.[7] ..... H01J 9/02
(52) U.S. Cl. ..... 445/6
(58) Field of Search ..... 445/6, 24, 38, 445/44, 62, 73; 427/77, 253

(56) References Cited

U.S. PATENT DOCUMENTS 4,625,678 A * 12/1986 Shioya et al. ..... 118/723 E
4,956,204 A * 9/1990 Amazawa et al. ..... 427/253
5,591,061 A * 1/1997 Ikeda et al. ..... 445/6
5,622,634 A 4/1997 Noma et al. ..... 216/40
6,169,356 B1 1/2001 Ohnishi et al. ..... 313/495
6,221,426 B1 * 4/2001 Yamanobe ..... 427/77
6,254,449 B1 * 7/2001 Nakanishi et al. ..... 445/25
6,306,001 B1 10/2001 Hiroki ..... 445/6
6,419,539 B1 * 7/2002 Tamura et al. ..... 445/6
6,465,952 B1 * 10/2002 Itoh et al. ..... 445/38

FOREIGN PATENT DOCUMENTS

JP 7-235255 9/1995
JP 8-171849 7/1996

* cited by examiner

*Primary Examiner*—Renee Luebke
*Assistant Examiner*—Felix O. Figueroa
(74) *Attorney, Agent, or Firm*—Fitzpatrick, Cella, Harper & Scinto

(57) ABSTRACT

A method for manufacturing an electron source includes the steps of covering a substrate provided with a first electrode and a second electrode by a container, introducing a gas composed of a carbon compound into the container, and forming a carbon film by applying a voltage between the first electrode and the second electrode. The relationship $1/(4/C_x-1/C_z)\geqq S_{out}\geqq 4S_{act}-C_{in}$ is satisfied, where $C_{in}$ is the conductance from the gas inlet to the position of the substrate nearest to the gas inlet, $C_x$ is the conductance from the position of the substrate nearest to the gas inlet to the position of the substrate nearest to the gas outlet, $S_{out}$ is the effective exhaust rate, $S_{act}$ is the consumption rate of the gas, and $C_z$ is the conductance from the substrate to the gas outlet. An apparatus for manufacturing an electron source and a method for manufacturing an image-forming apparatus are also disclosed.

15 Claims, 13 Drawing Sheets

APPARATUS FOR MANUFACTURING ELECTRON SOURCE, METHOD FOR MANUFACTURING ELECTRON SOURCE, AND METHOD FOR MANUFACTURING IMAGE-FORMING APPARATUS

BACKGROUND OF THE INVENTION

1. Field of the Invention

The present invention relates to an apparatus for manufacturing an electron source, a method for manufacturing an electron source, and a method for manufacturing an image-forming apparatus. More particularly, the invention concerns a planar image-forming apparatus.

2. Description of the Related Art

The operation of a surface conduction electron-emitting element is based on a phenomenon wherein electron emission occurs when a current flows through a thin, small film formed on a substrate, parallel with the film surface. The present applicant has made many suggestions regarding surface conduction electron-emitting elements having novel structures, and the applications thereof. The basic structure and manufacturing methods of surface conduction electron-emitting elements are disclosed, for example, in Japanese Patent Laid-Open Nos. 7-235255 and 8-171849.

A typical surface conduction electron-emitting element includes a pair of element electrodes opposed to each other on a substrate, and a conductive thin film which is connected to the pair of element electrodes and which is provided with an electron-emitting section. A crack is made in a part of the conductive thin film. A film containing at least one of carbon and a carbon compound as a principal constituent is formed at the edge of the crack.

By placing a plurality of such electron-emitting elements on a substrate and by joining the individual electron-emitting elements by wiring, an electron source provided with a plurality of surface conduction electron-emitting elements is manufactured. By combining the electron source and a phosphor layer, a display panel of an image-forming apparatuses manufactured.

Examples of conventional methods for manufacturing such a panel using the electron source will be described below.

In a first manufacturing method, first, an electron source substrate is fabricated, in which a plurality of elements formed on a substrate is joined by wiring, each element including a conductive film and a pair of element electrodes connected to the conductive film. The entire electron source substrate is placed in a vacuum chamber. After the vacuum chamber is evacuated, a crack is formed in the conductive film of each element using an external terminal. A gas containing an organic substance is introduced into the vacuum chamber, and a voltage is applied again through the external terminal to each element in an atmosphere containing the organic substance so that carbon or a carbon compound is deposited in the vicinity of the crack.

In a second manufacturing method, first, an electron source substrate is fabricated in which a plurality of elements formed on a substrate is joined by wiring, each element including a conductive film and a pair of element electrodes connected to the conductive film. Next, the electron source substrate and a substrate provided with a phosphor layer are joined to each other with a supporting frame therebetween to produce a panel of an image-forming apparatus. Next, a voltage is applied to the conductive film of each element through an external terminal to form a crack in the conductive film. A gas containing an organic substance is introduced into the panel space via an exhaust pipe of the panel and a voltage is applied again through the external terminal to each element in an atmosphere containing the organic substance so that carbon or a carbon compound is deposited in the vicinity of the crack.

In the first manufacturing method described above, in particular, as the size of the electron source substrate increases, a larger vacuum chamber and a high vacuum exhauster are required. In the second manufacturing method, it takes a long time to evacuate the panel space of the image-forming apparatus and to introduce the gas containing the organic substance into the panel space.

Moreover, in the manufacturing methods described above, an activation gas is consumed in the activation process in order to deposit the carbon or the carbon compound on the conductive films including electron-emitting sections Therefore, when the relationship between the consumption of the activation gas during activation and the flow of the activation gas in the panel or chamber is inappropriate, the activation gas partial pressure in the panel decreases over time during the activation process. If the pressure of the activation gas changes in the activation process, the characteristics of the electron-emitting elements after activation become irregular. Specifically, since the activation rate and the electron emission efficiency depend on the pressure of the activation gas, the luminance of the panel is irregular.

FIG. 13 is a graph illustrating the relationship between the activation gas partial pressure and the electron emission efficiency. The activation gas partial pressure in the horizontal axis is shown on a logarithmic scale. The measurements performed by the present inventors show that, if the activation gas partial pressure becomes 0.8 times the original partial pressure, the electron emission efficiency becomes 1.1 times the original efficiency. Therefore, the electron emission efficiency varies depending on the sequence of activation. As a result, variations in luminance exceed several percent, and the product does not exhibit satisfactory performance.

On the other hand, if the flow of the activation gas is too large, the range of partial pressure distribution in the vacuum chamber increases and the difference between the partial pressure in the vicinity of the gas inlet and the partial pressure in the vicinity of the gas outlet increases, resulting in irregular luminance, the same problem encountered when the activation gas partial pressure changes over time.

SUMMARY OF THE INVENTION

The objects of the present invention are to provide an apparatus for manufacturing an electron source having a superior electron emission characteristic and luminance uniformity at an improved manufacturing rate, with improved mass productivity, to provide a method for manufacturing the electron source, and to provide an image-forming apparatus using the electron source.

In one aspect of the present invention, in a method for manufacturing an electron source including an electron-emitting element having a first electrode, a second electrode, and a carbon film disposed between the first electrode and the second electrode, the-electron-emitting element being placed on a front surface of a substrate, the method includes the steps of covering a partial front surface or the entire front surface of the substrate provided with the first electrode and the second electrode by a container; introducing a gas composed of a carbon compound into the container via a gas inlet of the container; and forming the carbon film by applying a voltage between the first electrode and the second electrode, wherein the relationship $1/(4/C_x-1/C_z)\geqq S_{out}\geqq 4S_{act}-C_{in}$ is satisfied, where $C_{in}$ is the conductance from the gas inlet to the position of the substrate nearest to the gas inlet, $C_x$ is the conductance from the position of the substrate nearest to the gas inlet to the position of the substrate nearest to a gas outlet for evacuating the container, $S_{out}$ is the effective exhaust rate of an exhaust unit connected to the gas outlet, $S_{act}$ is the consumption rate of the gas consumed by applying the voltage to the electron-emitting element, and $C_z$ is the conductance from the substrate to the gas outlet.

In the method for manufacturing the electron source, preferably, the electron source includes a plurality of electron-emitting elements, and the relationship $1/(4/C_x-1/C_z)\geqq S_{out}\geqq 4\cdot n\cdot S_{act1}-C_{in}$ is satisfied, where $S_{act1}$ is the consumption rate of the gas for each element, and n is the number of elements simultaneously subjected to the step of forming the carbon film.

In the method for manufacturing the electron source, preferably, the electron source includes a plurality of electron-emitting elements, a plurality of X-direction lines for commonly connecting a plurality of first electrodes, and a plurality of Y-direction lines for commonly connecting a plurality of second electrodes, and in the step of forming the carbon film, the voltage is applied between each first electrode and each second electrode through the X-direction line and/or the Y-direction line.

In the method for manufacturing the electron source, preferably, in the step of forming the carbon film, the carbon film is simultaneously formed on the elements connected to some of the X-direction lines adjacent to each other.

In the method for manufacturing the electron source, preferably, in the step of forming the carbon film, the carbon film is simultaneously formed on the elements connected to some of the X-direction lines nonadjacent to each other.

In another aspect of the present invention, in a method for manufacturing an image-forming apparatus, the image forming apparatus including: an electron source including an electron-emitting element having a first electrode, a second electrode, and a carbon film disposed between the first electrode and the second electrode, the electron-emitting element being placed on a front surface of a substrate; and an image-forming member facing the electron source and forming an image by electrons emitted from the electron-emitting element, the method includes the steps of covering a partial front surface or the entire front surface of the substrate provided with the first electrode and the second electrode by a container; introducing a gas composed of a carbon compound into the container via a gas inlet of the container; and forming the carbon film by applying a voltage between the first electrode and the second electrode, wherein the relationship $1/(4/C_x-1/C_z)\geqq S_{out}4S_{act}-C_{in}$ is satisfied, where $C_{in}$ is the conductance from the gas inlet to the position of the substrate nearest to the gas inlet, $C_x$ is the conductance from the position of the substrate nearest to the gas inlet to the position of the substrate nearest to a gas outlet for evacuating the container, $S_{out}$ is the effective exhaust rate of an exhaust unit connected to the gas outlet, $S_{act}$ is the consumption rate of the gas consumed by applying the voltage to the electron-emitting element, and $C_z$ is the conductance from the substrate to the gas outlet.

In the method for manufacturing the image-forming apparatus, preferably, the electron source includes a plurality of electron-emitting elements, and the relationship $1/(4/C_x-1/C_z)\geqq S_{out}\geqq 4\cdot n\cdot S_{act1}-C_{in}$ is satisfied, where $S_{act1}$ is the consumption rate of the gas for each element, and n is the number of elements simultaneously subjected to the step of forming the carbon film.

In the method for manufacturing the image-forming apparatus, preferably, the electron source includes a plurality of electron-emitting elements, a plurality of X-direction lines for commonly connecting a plurality of first electrodes, and a plurality of Y-direction lines for commonly connecting a plurality of second electrodes, and in the step of forming the carbon film, the voltage is applied between each first electrode and each second electrode through the X-direction line and/or the Y-direction line.

In the method for manufacturing the image-forming apparatus, preferably, in the step of forming the carbon film, the carbon film is simultaneously formed on the elements connected to some of the X-direction lines adjacent to each other.

In the method for manufacturing the image-forming apparatus, preferably, in the step of forming the carbon film, the carbon film is simultaneously formed on the elements connected to some of the X-direction lines nonadjacent to each other.

In another aspect of the present invention, in an apparatus for manufacturing an electron source, the electron source including an electron-emitting element having a first electrode, a second electrode, and a carbon film disposed between the first electrode and the second electrode, the electron-emitting element being placed on a front surface of a substrate, the apparatus includes: a base for supporting the substrate preliminarily provided with the first electrode and the second electrode; a container for covering the front surface of the substrate supported by the base; and a voltage-applying unit, wherein, in the steps of covering a partial front surface or the entire front surface of the substrate provided with the first electrode and the second electrode by the container; introducing a gas composed of a carbon compound into the container via a gas inlet of the container: and forming the carbon film by applying a voltage between the first electrode and the second electrode using the voltage-applying unit, the relationship $1/(4/C_x-1/C_z)\geqq S_{out}\geqq 4S_{act}-C_{in}$ is satisfied, where $C_{in}$ is the conductance from the gas inlet to the position of the substrate nearest to the gas inlet, $C_x$ is the conductance from the position of the substrate nearest to the gas inlet to the position of the substrate nearest to a gas outlet for evacuating the container, $S_{out}$ is the effective exhaust rate of an exhaust unit connected to the gas outlet, $S_{act}$ is the consumption rate of the gas consumed by applying the voltage to the electron-emitting element, and $C_z$ is the conductance from the substrate to the gas outlet.

In the apparatus for manufacturing the electron source, preferably, the electron source includes a plurality of electron-emitting elements, and the relationship $1/(4/C_x-1/C_z)\geqq S_{out}\geqq 4\cdot n\cdot S_{act1}-C_{in}$ is satisfied, where $S_{act1}$ is the consumption rate of the gas for each element, and n is the number of elements simultaneously subjected to the step of forming the carbon film.

In the apparatus for manufacturing the electron source, preferably, the electron source includes a plurality of electron-emitting elements, a plurality of X-direction lines for commonly connecting a plurality of first electrodes, and a plurality of Y-direction lines for commonly connecting a plurality of second electrodes, and in the step of forming the carbon film, the voltage is applied between each first electrode and each second electrode through the X-direction line and/or the Y-direction line.

In the apparatus for manufacturing the electron source, preferably, in the step of forming the carbon film, the carbon film is simultaneously formed on the elements connected to some of the X-direction lines adjacent to each other.

In the apparatus for manufacturing the electron source, preferably, in the step of forming the carbon film, the carbon film is simultaneously formed on the elements connected to some of the X-direction lines nonadjacent to each other.

As described above, in accordance with the present invention, an apparatus for manufacturing an electron source includes a base for supporting a substrate preliminarily provided with a conductor (a first electrode and a second electrode), and a container for covering the substrate supported by the base. The container covers the surface of the substrate partially, and thus it is possible to form an airtight space on the substrate with the lines connected to the conductor formed on the substrate being partially exposed to the outside of the container. The container is also provided with a gas inlet and a gas outlet. The inlet and the outlet are connected to a unit for introducing a gas to the container and a unit for discharging a gas from the container, respectively. Thereby, the atmosphere inside the container can be controlled to achieve desired conditions. The substrate preliminarily provided with the conductor is a substrate in which an electron-emitting section is formed in the conductor by an electrical process to produce an electron source. Therefore, the manufacturing apparatus of the present invention further includes a unit for performing the electrical process, for example, a unit for applying a voltage to the conductor. In such a manufacturing apparatus, reduction in size is achieved; operations, such as making an electrical connection to a power source during the electrical process, can be facilitated; and there is further freedom with regard to the design for the size and shape of the container so that introduction of the gas into the container and discharge of the gas from the container can be performed quickly.

As described above, in accordance with the present invention, in a method for manufacturing an electron source, first, a substrate on which a conductor and lines connected to the conductor are preliminarily formed is placed on a base, and the conductor on the substrate is covered by a container, excluding parts of the lines. Thus, the conductor is placed in an airtight space formed on the substrate with the lines formed on the substrate being partially exposed to the outside of the container. Next, the atmosphere in the container is controlled to achieve desired conditions, and an electrical process is performed on the conductor via the parts of the lines exposed to the outside of the container, for example, a voltage is applied to the conductor. The desired atmosphere is, for example, a reduced-pressure atmosphere or an atmosphere in which a predetermined gas is present. The electrical process is a process in which an electron-emitting section is formed in the conductor to produce an electron source. The electrical process may be performed a plurality of times in different atmospheres. For example, after the conductor on the substrate is covered by the container, excluding parts of the lines, the electrical process is performed in a first atmosphere, and then the electrical process is performed in a second atmosphere. A satisfactory electron-emitting section is thereby formed in the conductor and an electron source is produced. As will be described below, the first atmosphere is a reduced-pressure atmosphere, and the second atmosphere is an atmosphere in which a gas composed of a carbon compound or the like is present.

When the electrical process is performed in the second atmosphere, such as in a gas of a carbon compound, in order to suppress the change of the partial pressure of the gas in the vacuum container over time and in order to suppress the range of partial pressure distribution in the vicinity of the electron-emitting element, the following measures are taken. That is, it is possible to limit the amount of the reduction in the average partial pressure to 20% or less and to limit the range of partial pressure distribution in the image region to 20% or less, by setting the conditions so as to satisfy the relationship $1/(4/C_x-1/C_z)\geqq S_{out}\geqq 4S_{act}-C_{in}$, where $S_{out}$ is the effective exhaust rate which corresponds to the combined conductance of the exhaust side conductance of a manufacturing apparatus and the exhaust rate of a pump, for example, as shown in FIG. 10, $S_{act}$ is the consumption rate of an activation gas during activation, $C_{in}$ is the conductance from the gas inlet to the position of the substrate nearest to the gas inlet, $C_x$ is the conductance from the position of the substrate nearest to the gas inlet to the position of the substrate nearest to a gas outlet, and $C_z$ is the conductance from the substrate to the gas outlet.

In such a manufacturing method, operations, such as making an electrical connection to a power source during the electrical process, can be facilitated. Since there is further freedom with regard to the design for the size and shape of the container. etc., introduction of a gas into the container and discharge of a gas from the container can be performed quickly, thereby improving the manufacturing rate as well as improving consistency in the electron emission of the electron sources manufactured, in particular, improving uniformity of the electron emission of an electron source having a plurality of electron-emitting sections.

When the electrical process is performed in a gas composed of a carbon compound, since it is possible to limit the amount of the reduction in the average partial pressure in the container to 20% or less and to limit the range of partial pressure distribution in the image area to 20% or less, the range of the variation in luminance can be set to be within several percent.

Further objects, features and advantages of the present invention will become apparent from the following description of the preferred embodiments with reference to the attached drawings.

DESCRIPTION OF THE PREFERRED EMBODIMENTS

The preferred embodiments of the present invention will be described in detail with reference to the drawings.

FIRST EMBODIMENT

Figure 1:
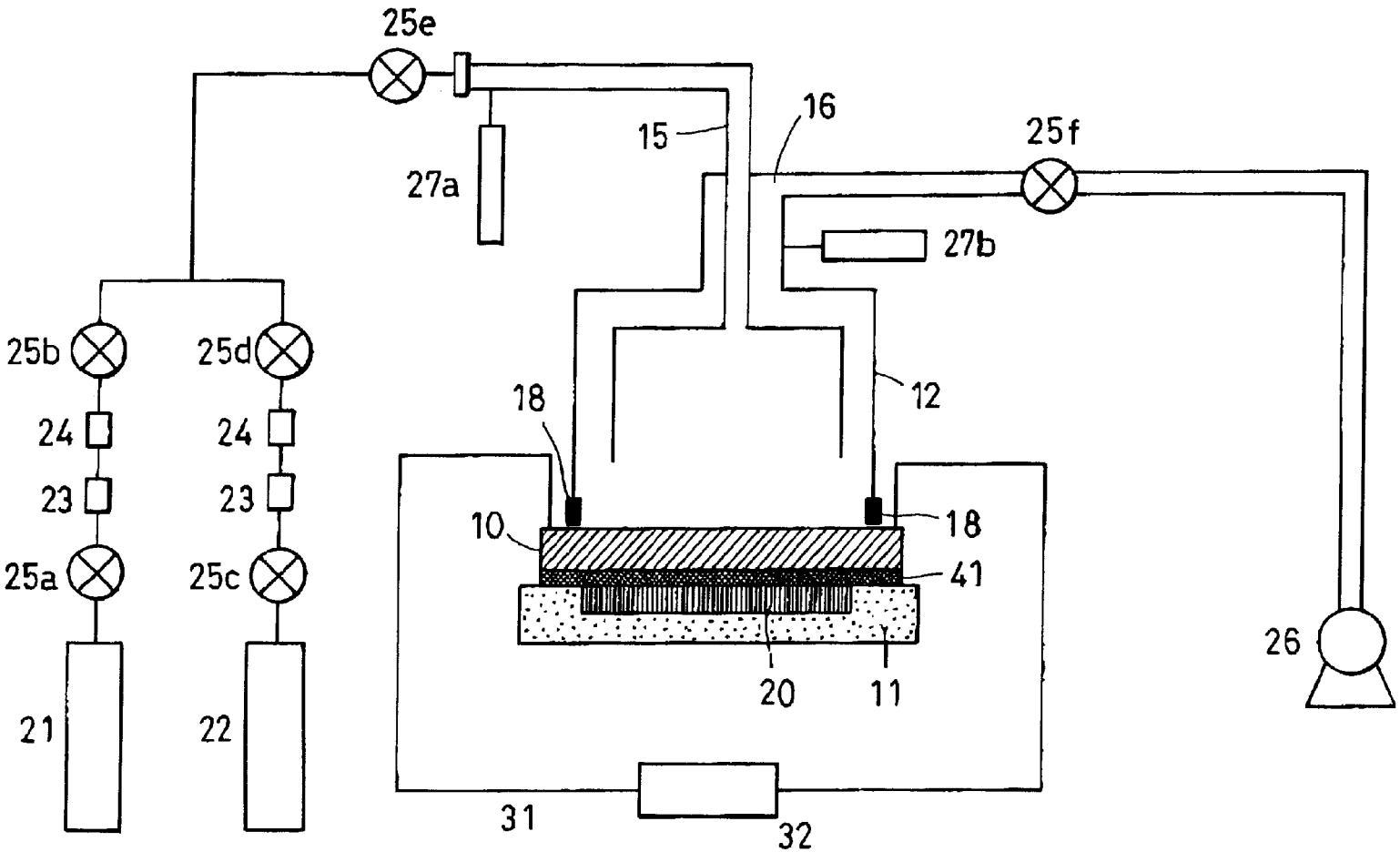
FIG. 1 is a sectional view showing the structure of an apparatus for manufacturing an electron source in a first embodiment of the present invention.
Figure 6:
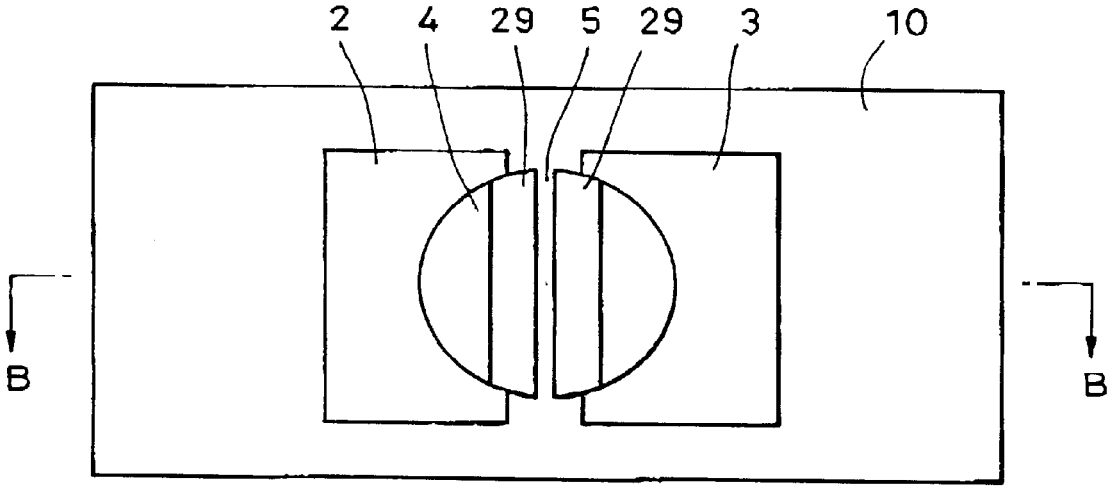
FIG. 6 is a plan view showing the structure of an electron-emitting element of the present invention.
Figure 7:
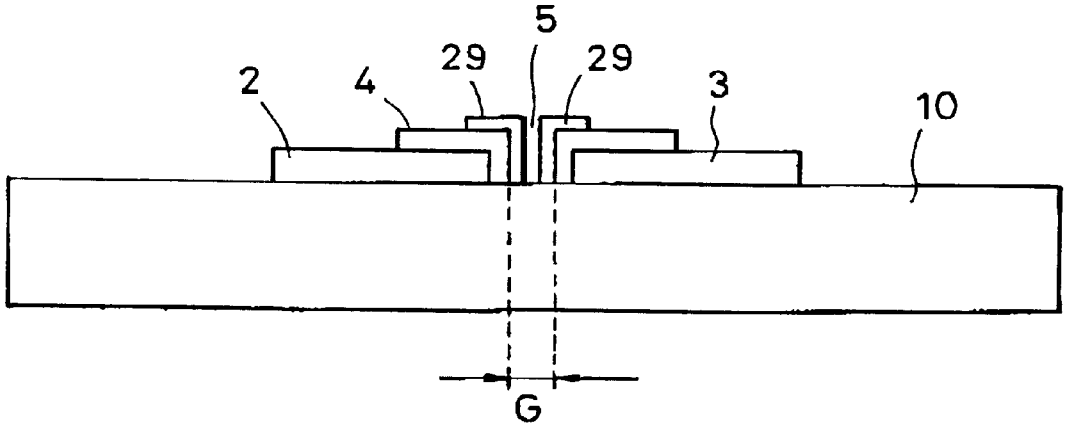
FIG. 7 is a sectional view showing the structure of an electron-emitting element of the present invention.
Figure 9:
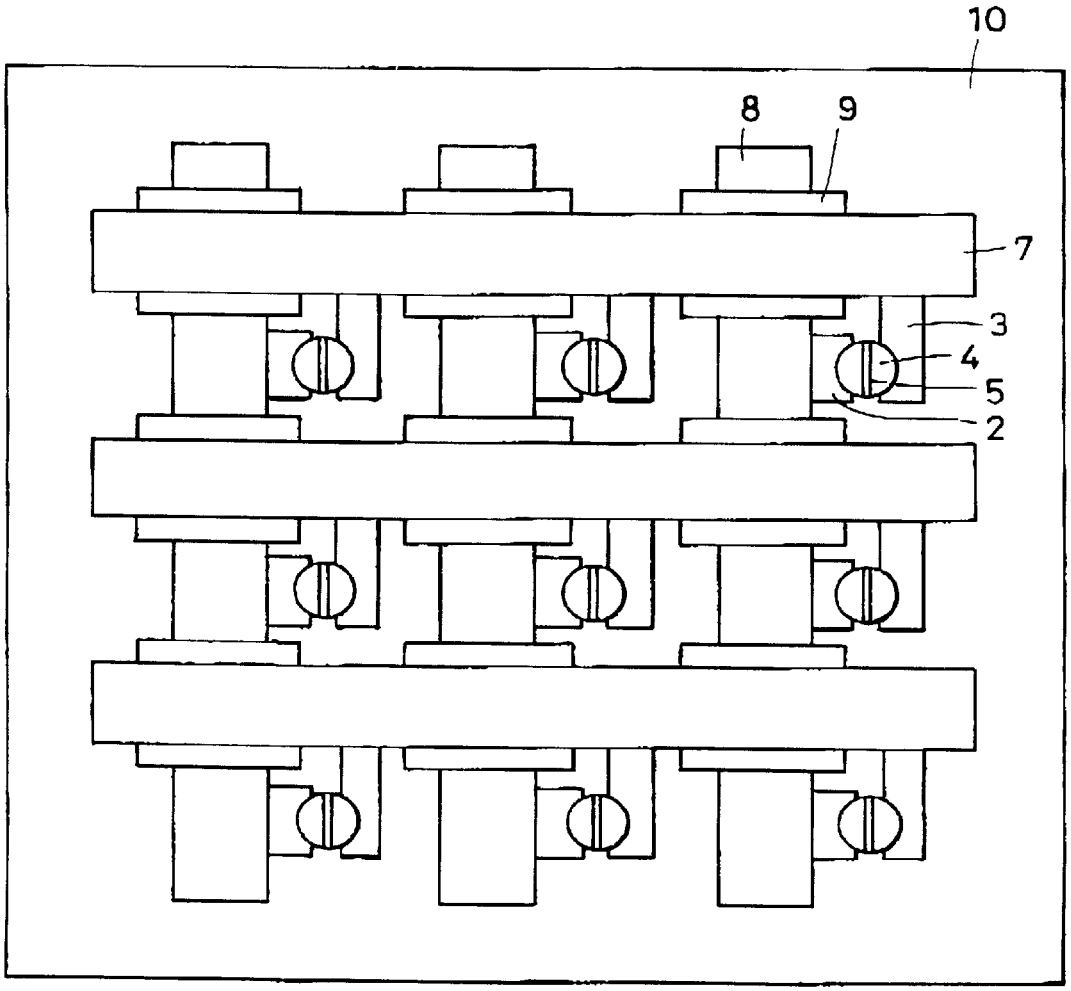
FIG. 9 is a plan view showing an electron source of the present invention.

In this embodiment, using a manufacturing apparatus of the present invention, an electron source shown in FIG. 9 having a plurality of surface conduction electron-emitting elements shown in FIGS. 6 and 7 is manufactured. FIG. 1 is a sectional view of an apparatus for manufacturing an electron source in accordance with the present invention, and FIG. 2 is a perspective view showing the periphery of an electron source substrate shown in FIG. 1.

Figure 2:
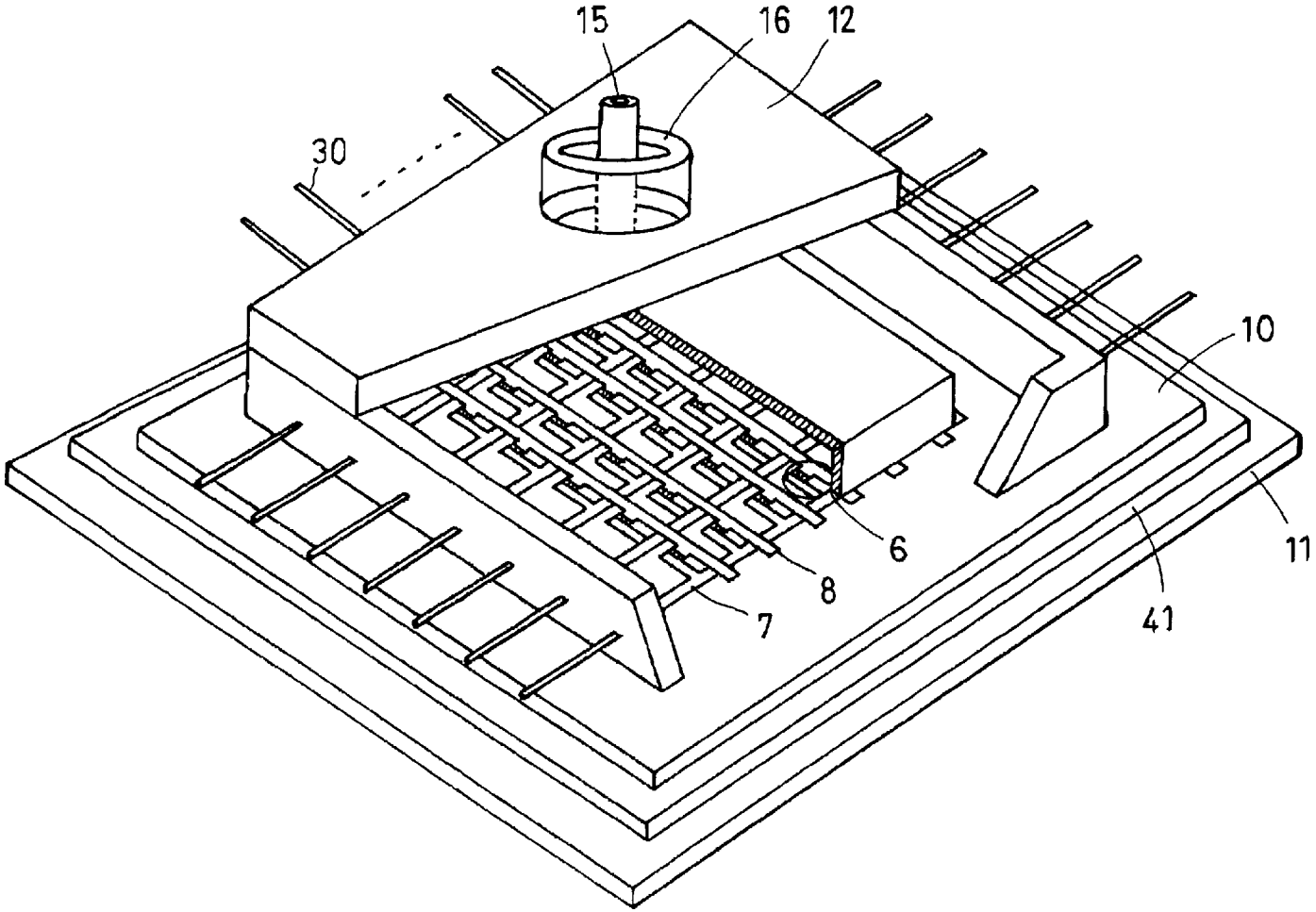
FIG. 2 is a partially cutaway, perspective view which shows the periphery of the electron source shown in FIG. 1.

In FIGS. 1 and 2, numeral 6 represents a conductor for forming an electron-emitting element, numeral 7 represents an X-direction line, numeral 8 represents a Y-direction line, numeral 10 represents an electron source substrate, numeral 11 represents a base, numeral 12 represents a vacuum container, numeral 15 represents a gas inlet, numeral 16 represents a gas outlet, numeral 18 represents a sealing member, numeral 20 represents a heater, numeral 21 represents hydrogen or an organic substance gas, numeral 23 represents a water-removing filter, numeral 24 represents a gas flow control device, numerals 25*a* to 25*f* represent valves, numeral 26 represents a vacuum pump, numeral 27*a* represents a vacuum gauge at the gas inlet side, numeral 27*b* represents a vacuum gauge at the exhaust side, numeral 30 represents a lead, numeral 32 represents a driver including a power source and a current control system, numeral 31 represents wiring connecting between the lead 30 and the driver 32, and numeral 41 represents a heat-conduction member.

Figure 8:
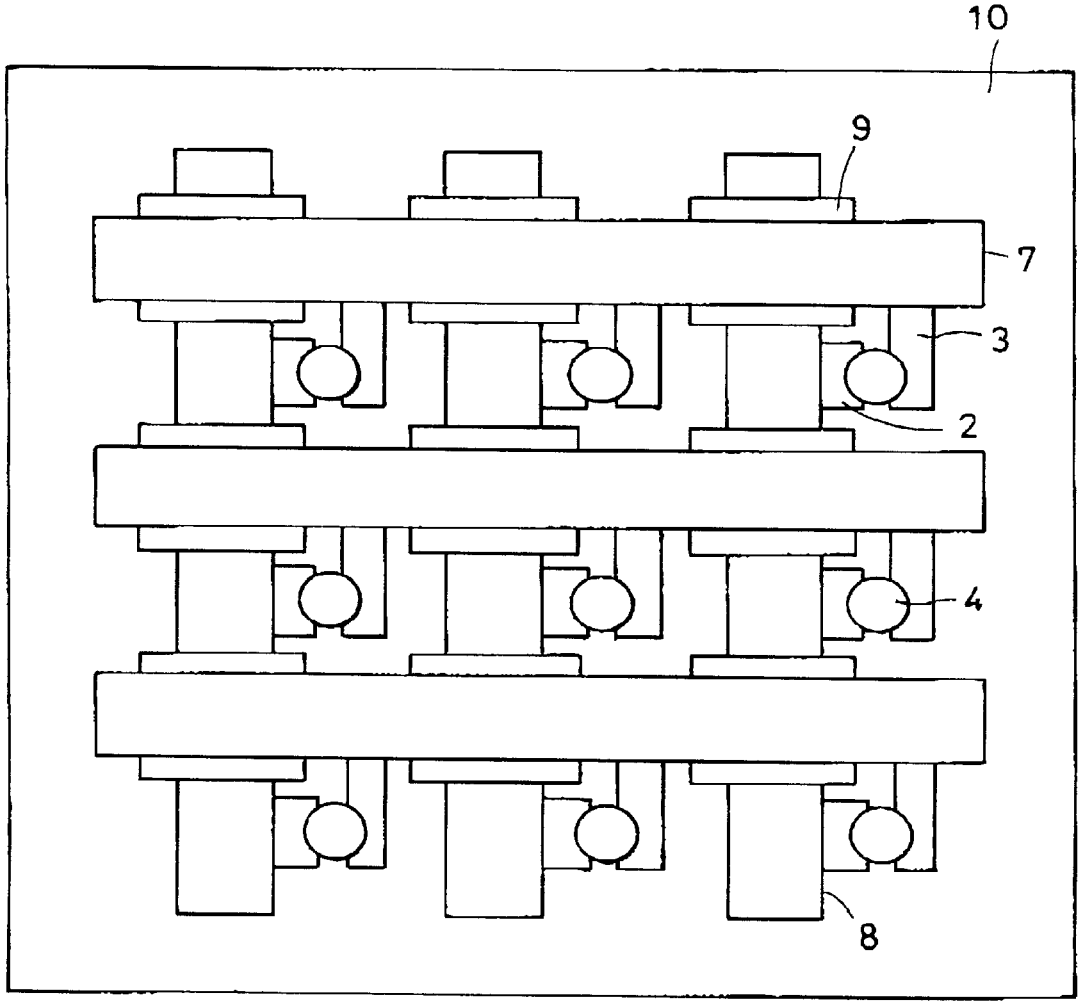
FIG. 8 is a plan view illustrating the manufacturing process of an electron source of the present invention.

In FIGS. 6 to 9, numerals 2 and 3 both represent an element electrode, numeral 4 represents a conductive film, numeral 29 represents a carbon film, numeral 5 represents a gap between the carbon films 29, symbol G represents a gap between the conductive films 4. A Pt paste is printed on a glass substrate (size: 350 mm×300 mm, thickness: 5 mm) provided with an $SiO_2$ layer by offset printing, and firing is performed to form the element electrodes 2 and 3 shown in FIG. 7. By printing an Ag paste by screen printing, followed by firing, X-direction lines 7 and Y-direction lines 8 shown in FIGS. 8 and 9 are formed. At the intersections of the X-direction lines 7 and the Y-direction lines 8, an insulating paste is printed by screen printing, and firing is performed to form insulating layers 9.

Using a bubble-jet system, a palladium complex solution is applied dropwise between the element electrodes 2 and 3, and heating is performed at 350° C. for 30 minutes to form the conductive films 4 composed of palladium oxide shown in FIG. 8. The conductive films 4 have a thickness of 20 nm. In this way, the electron source substrate 10 is fabricated such that a plurality of conductors composed of the element electrodes 2 and 3 and the conductive films 4 is arranged in a matrix by the X-direction lines 7 and the Y-direction lines 8.

The electron source substrate 10 thus obtained is fixed on the base 11 of the manufacturing apparatus shown in FIGS. 1 and 2. The elastic heat-conduction member 41 is interposed between the base 11 and the electron source substrate 10.

Next, the vacuum container 12 composed of stainless steel is disposed on the electron source substrate 10 with the sealing member 18 composed of a silicone rubber therebetween such that leads 30 protrude from the vacuum container 12.

The valve 25*f* at the gas outlet 16 side is opened and the vacuum container 12 is evacuated until the pressure is approximately $1.33\times10^{-1}$ Pa ($1\times10^{-3}$ Torr) by the vacuum pump 26 (scroll pump), and then, in order to remove water which may be attached to the piping of the exhaust unit and the electron source substrate 10, the temperature is increased to 120° C. using a heater for piping which is not shown in the drawing and the heater 20 for the electron source substrate 10, the temperature is retained for 2 hours, and the substrate is slowly cooled to room temperature.

After the temperature of the substrate is returned to room temperature, a forming process is performed on the conductive films in which a voltage is applied between the element electrodes 2 and 3 in the individual electron-emitting elements 6 through the X-direction lines 7 and the Y-direction lines 8 using the driver 32 connected to the leads 30 shown in FIG. 2 through the wiring 31 shown in FIG. 1, thereby forming the gap G as shown in FIGS. 7 and 9.

Next, an activation process is performed. The valves 25*a* and 25*b* for supplying gas and the valve 25*e* at the gas inlet side shown in FIG. 1 are opened and the organic substance gas 21 is introduced into the vacuum container 12. Benzonitrile is used as the organic substance gas 21, and the degree of opening of the valve 25*e* is adjusted while monitoring the pressure measured by the vacuum gauge 27*a* at the gas inlet side so that the pressure in the vacuum container is $4\times10^{-4}$ Pa ($3\times10^{-6}$ Torr).

In the activation process, a carbon film is deposited in the vicinity of the gap G of the conductive film 4 using an activation gas as a raw material, and the activation gas is consumed during activation. If the consumption is large compared to the flow of the activation gas flowing through the vacuum container, the activation gas partial pressure is decreased during activation, and electron emission will differ depending on the sequence of activation for the electron-emitting elements on the substrate. Research by the present inventors shows that, if the change in the activation gas partial pressure is 20% during activation, the change in efficiency (current $I_e$ reaching phosphor layer/current $I_f$ flowing between element electrodes) is 10%. If the change in the partial pressure during activation exceeds 20%, variations in luminance exceed several percent, and the resulting product will not exhibit satisfactory performance.

Figure 11:
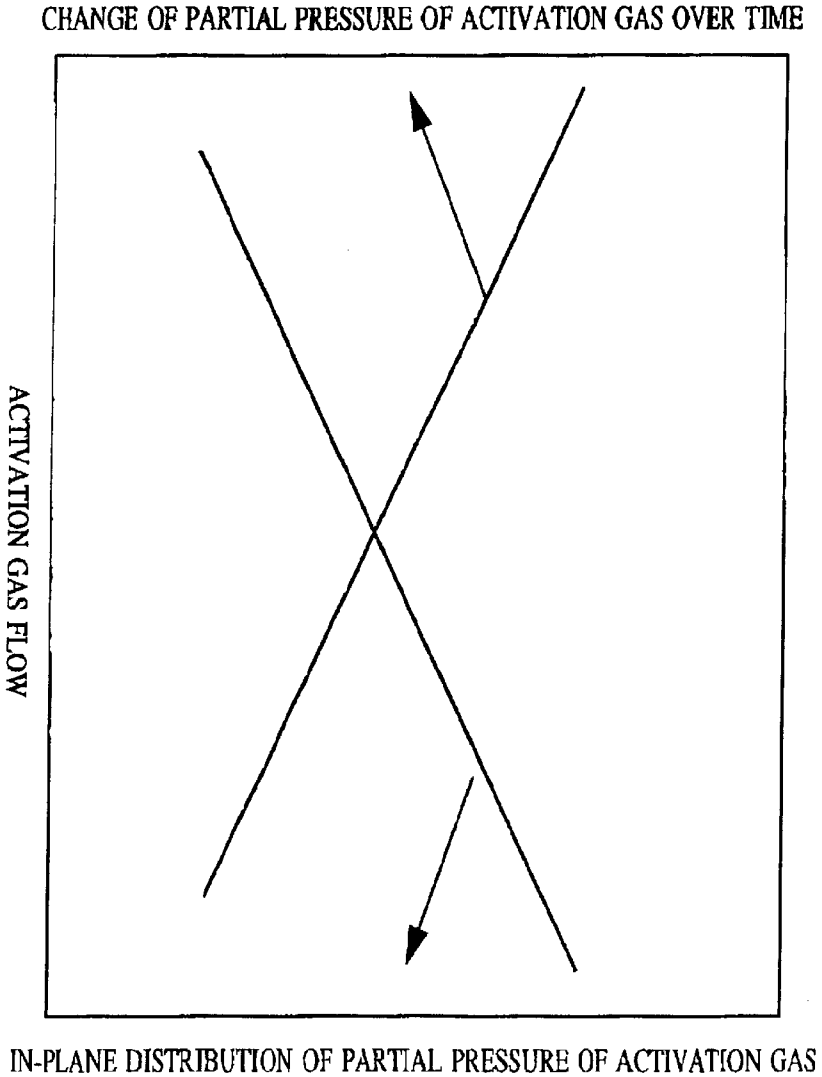
FIG. 11 is a diagram illustrating relationships between the activation gas flow and the change of activation gas partial pressure over time and between the activation gas flow and the distribution of the partial pressure in the activation process for an electron source in the present invention.

On the other hand, if the flow of the activation gas is too large, the in-plane distribution of the partial pressure occurs on the substrate, resulting in irregular luminance, the same problem encountered when the activation gas partial pressure changes over time. FIG. 11 is a diagram illustrating relationships between the activation gas flow and the change of the activation gas partial pressure over time and between the activation gas flow and the in-plane distribution of the partial pressure. As shown in FIG. 11, the change of the activation gas partial pressure over time has a characteristic which is opposite that of the in-plane distribution of the partial pressure, and depending on the conditions for the introduction and exhaust of the gas, the variations in electron emission increase.

In this embodiment, the introduction and exhaust of the activation gas are adjusted so that the amount of the reduction in the partial pressure during activation is limited to 20% or less.

Figure 10:
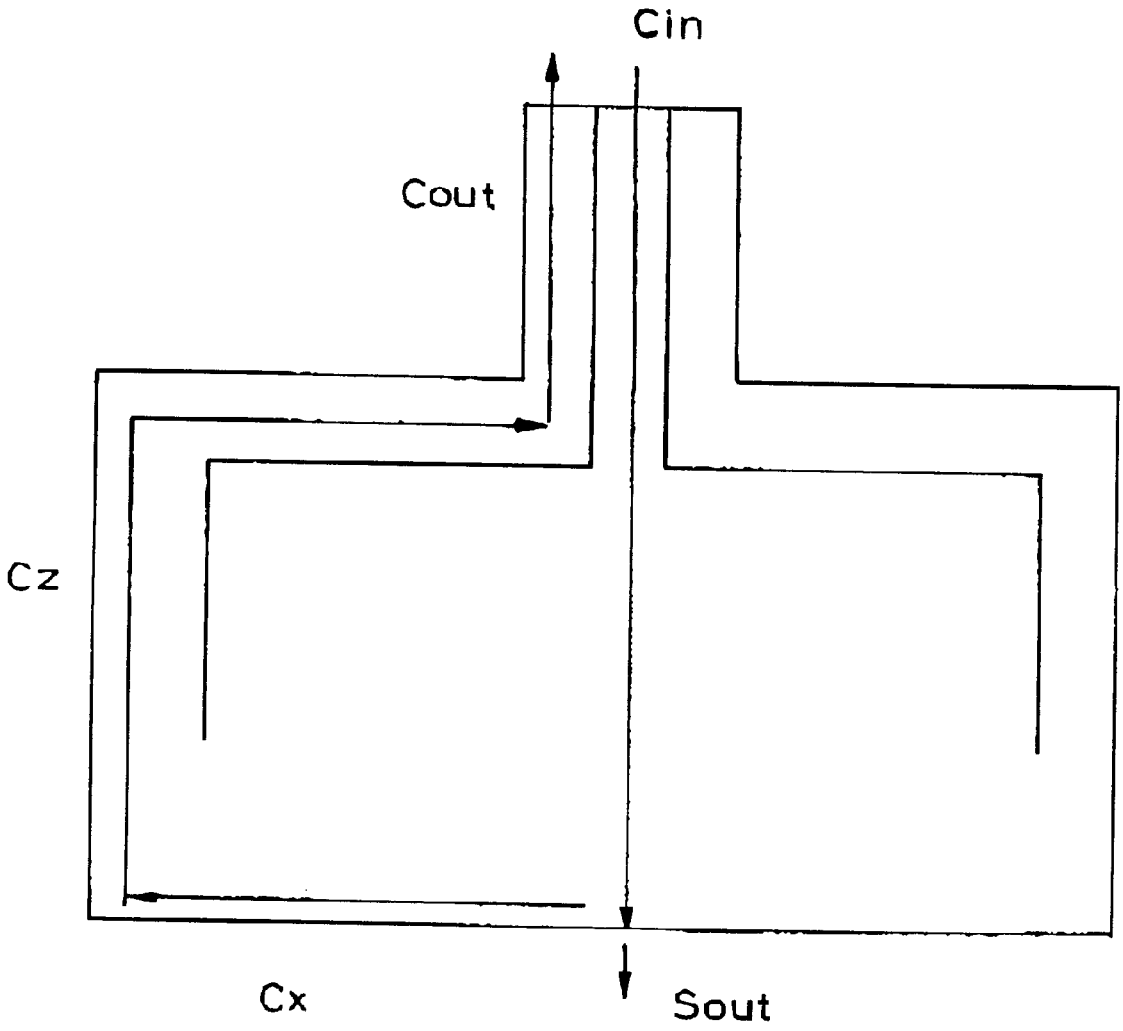
FIG. 10 is a schematic diagram showing conductance of an apparatus for manufacturing an electron source of the present invention.

It is possible to limit the amount of the reduction in the average partial pressure to 20% or less and to limit the range of partial pressure distribution to 20% or less for the activation gas in the vacuum container 12, by setting the conditions so as to satisfy the relationship $1/(4/C_x-1/C_z)\geqq S_{out}\geqq 4S_{act}-C_{in}$, where, as shown in FIG. 10, $S_{out}$ is the effective exhaust rate which corresponds to the combined conductance of the exhaust side conductance of the manufacturing apparatus and the exhaust rate of the pump, $S_{act}$ is the consumption rate of the activation gas during activation, $C_{in}$ is the conductance from the gas inlet to the position of the substrate nearest to the gas inlet, $C_x$ is the conductance from the position of the substrate nearest to the gas inlet to the position of the substrate nearest to the gas outlet, and $C_z$ is the conductance from the substrate to the gas outlet.

Research by the present inventors shows that the consumption rate $S_{act}$ of the activation gas is approximately 0.4 l/s under the conditions of this embodiment. In the manufacturing apparatus used in this embodiment, the inlet side conductance $C_{in}$ is approximately 1 l/s. In consideration of the conditions described above, the effective exhaust rate at the exhaust side is set at 0.6 l/s.

After the organic substance gas is introduced into the container, the activation process is performed by applying a voltage between the electrodes 2 and 3 of the individual electron-emitting elements 6 through the X-direction lines 7 and the Y-direction lines 8 using the driver 32. The voltage is controlled so that it increases from 10 V to 17 V, and the activation period is set to 30 minutes. Additionally, all the Y-direction lines 8 and unselected X-direction lines 7 are commonly connected to a Gnd (ground potential), and ten X-direction lines 7 are selected, to which a pulsed voltage is applied sequentially. By repeating the above method, the activation process is performed on all the X-direction lines 7.

As shown in FIGS. 6 and 7, carbon films 29 interposed by the gap 5 are formed on the electron-emitting element on which the activation process has been performed.

As a result of the gas analysis at the gas outlet 16 side using a mass spectrometer with a differential pumping device (not shown in the drawing) during the activation process, it has been found that, as the gas is introduced, the mass No. 103 of benzonitrile is increased and saturated, and the decrease in the value during the activation process is 20% or less.

The electron source substrate 10 on which the above process has been performed is aligned with a face plate provided with a glass frame and a phosphor layer, and sealing is performed using a low-melting glass to fabricate a vacuum envelope. The envelope is evacuated, baked, and to sealed to fabricate an image-forming apparatus.

Figure 12:
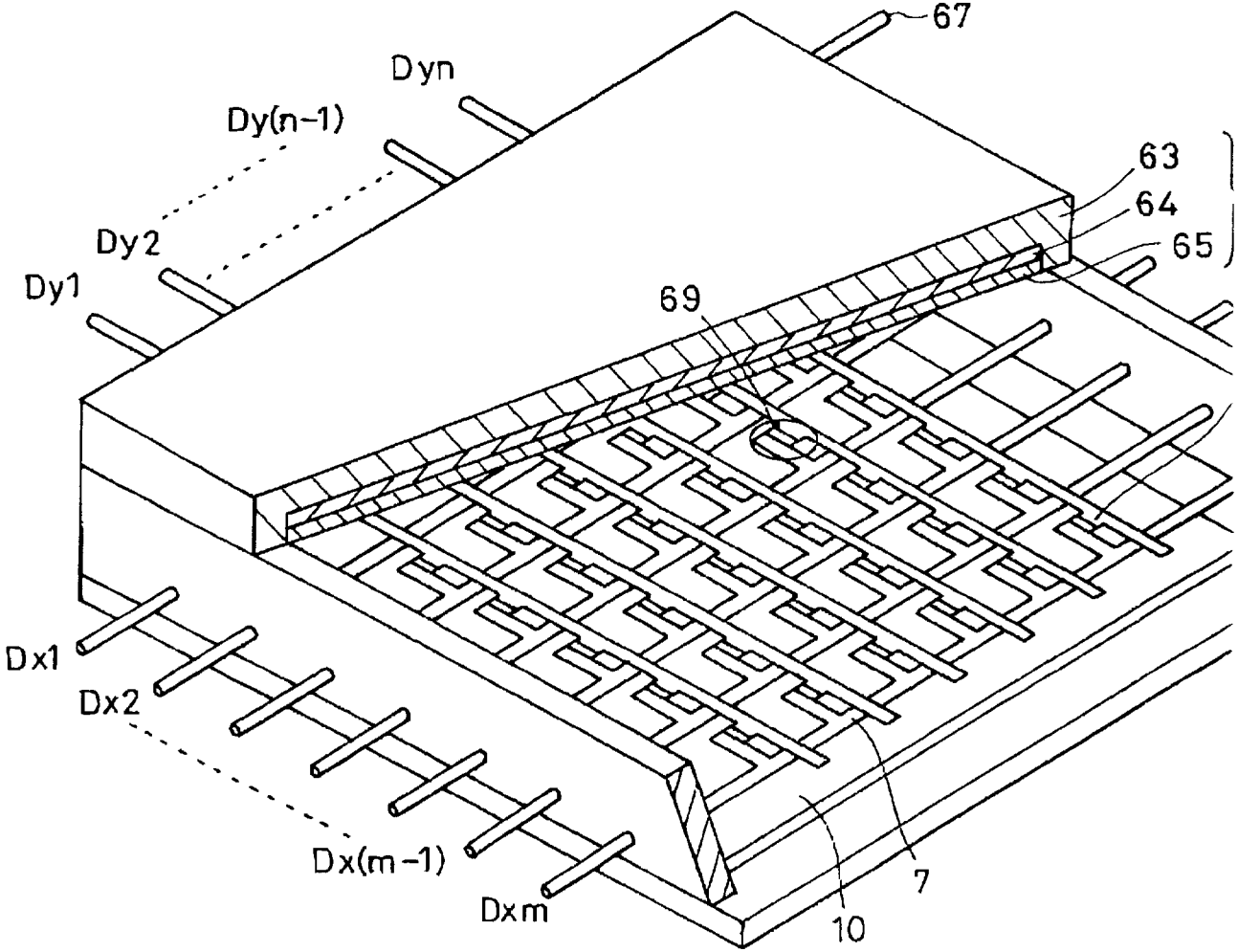
FIG. 12 is a schematic diagram of an image-forming apparatus manufactured by combining an electron source and an image-forming member.
Figure 13:
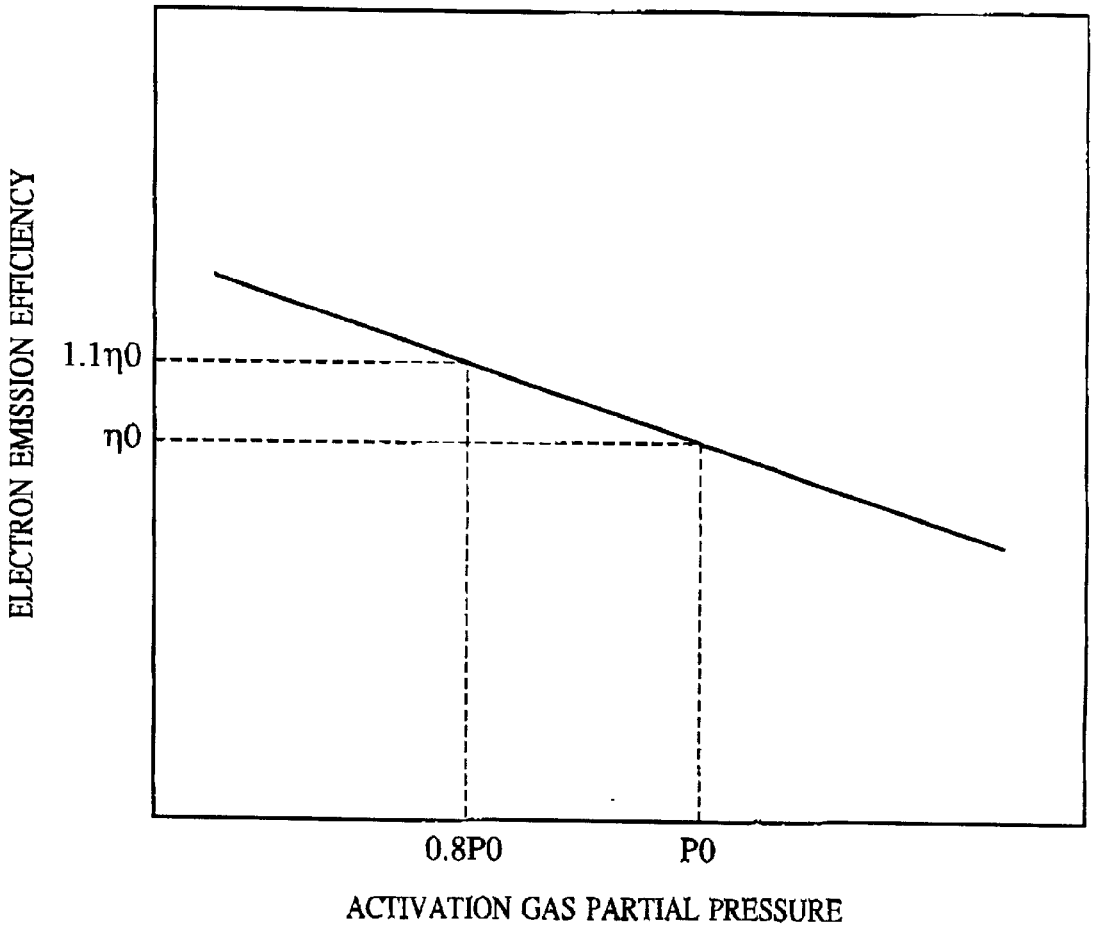
FIG. 13 is a graph showing a relationship between the activation gas partial pressure and the electron emission efficiency in the activation process for an electron source.

FIG. 12 is a schematic diagram of an image-forming apparatus fabricated by combining the electron source and the image-forming member. In FIG. 12, numeral 69 represents an electron-emitting element, numeral 61 represents a rear plate on which the electron source substrate 10 is fixed, numeral 62 represents a support, numeral 66 represents a face plate including a glass substrate 63, a metal back 65, and a phosphor layer 64, numeral 67 represents a high-voltage terminal, and numeral 68 represents an image-forming apparatus.

In the image-forming apparatus 68, scanning signals and modulating signals are applied to the individual electron-emitting elements through external terminals $D_{x1}$ to $D_{xm}$ and external terminals $D_{y1}$ to $D_{yn}$, respectively, by signal-generating units (not shown in the drawing) so that electrons are emitted. By applying a high voltage of 5 kV to the metal back 65 or a transparent electrode (not shown in the drawing) through the high-voltage terminal 67, an electron beam is accelerated and forced to collide with the phosphor layer 64, and thereby excitation and luminescence are caused so that an image is displayed.

Additionally, the electron source substrate 10 itself may also function as a rear plate. Scanning signal wiring may be placed on one side as long as the number of elements is small and a voltage drop does not affect the electron source, for example, between the electron-emitting element close to the external terminal $D_{x1}$ and the electron-emitting element far from the external terminal $D_{x1}$. When the number of elements is large and a considerable voltage drop occurs, the wiring width may be increased, the wiring thickness may be increased, or voltages may be applied from both sides.

In this embodiment, it is possible to fabricate satisfactory surface conduction electron-emitting elements having more uniform characteristics than the conventional panel, and it is possible to manufacture an image-forming panel in which uniformity is improved and variations in luminance are decreased.

SECOND EMBODIMENT

In this embodiment, an apparatus similar to that shown in FIG. 1, except that a diffuser panel 19 is disposed in a vacuum container 12, is used A forming process is performed to form a gap G in a conductive film shown in FIG. 7 and an activation process is performed in the same manner as in the first embodiment, and thus an electron source is manufactured.

Figure 3:
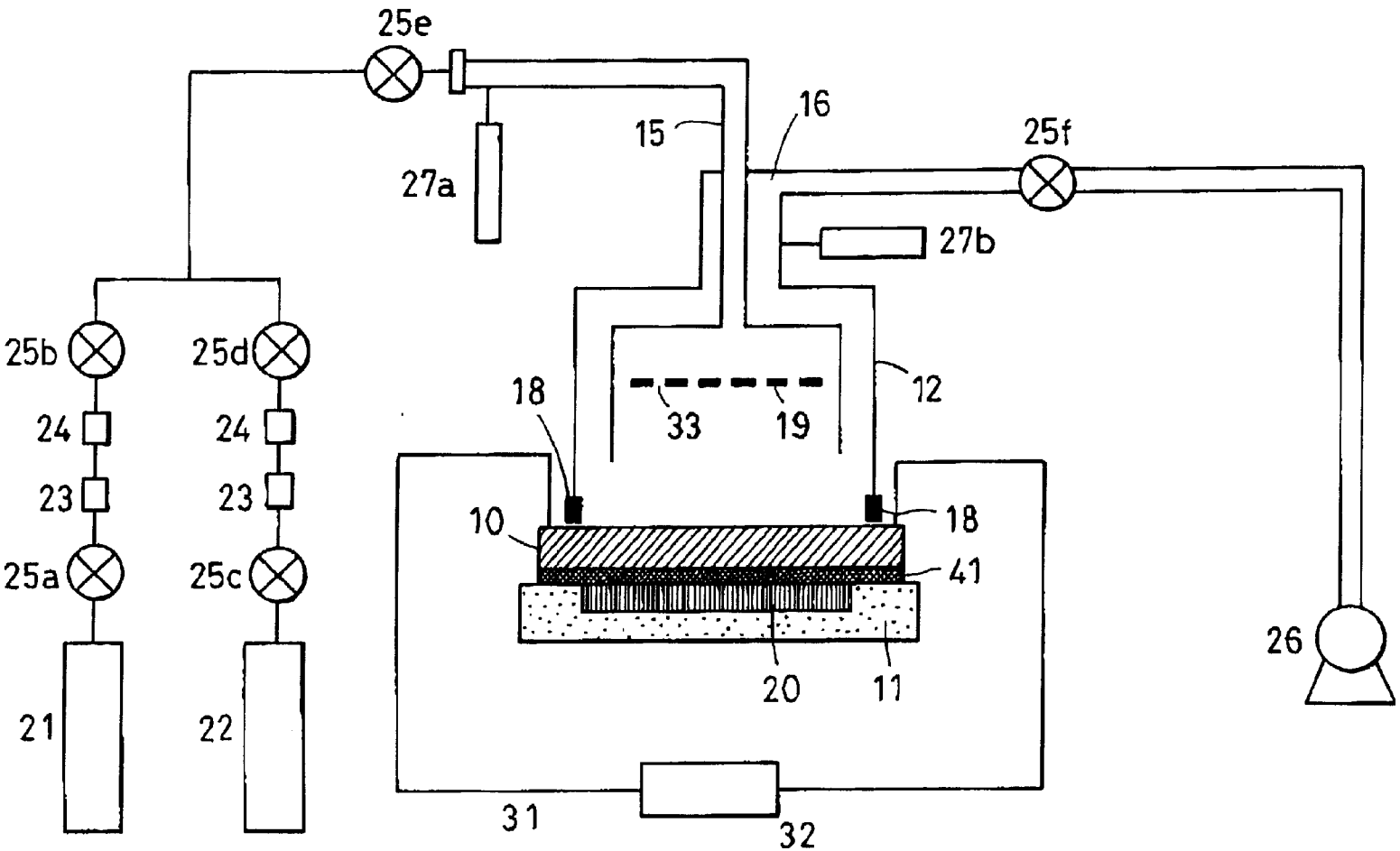
FIG. 3 is a sectional view showing the structure of an apparatus for manufacturing an electron source in a second embodiment of the present invention.

FIG. 3 is a sectional view showing the structure of an apparatus for manufacturing an electron source in the second embodiment. The diffuser panel 19 provided with openings 33 is disposed above an electron source substrate 10. With respect to the openings 33 of the diffuser panel 19, an opening in the center (at the intersection point between the extension from the center of the gas inlet and the diffuser panel) is circular with a diameter of 1 mm, and openings are placed in a concentric shape, radially with a spacing of 5 mm and circumferentially with a spacing of 5° so as to satisfy the equation below. The distance from the center of the gas inlet to the intersection point between the extension from the center of the gas inlet and the diffuser panel is set to 20 mm.

$$S_d=S_0\times[1+(d/L)2]1/2$$

where d is the distance from the intersection point between the extension from the center of the gas inlet and the diffuser panel, L is the distance from the center of the gas inlet to the intersection point between the extension from the center of the gas inlet and the diffuser panel, $S_d$ is an opening area at a distance d from the intersection point between the extension from the center of the gas inlet and the diffuser panel, and $S_0$ is an opening area at the intersection point between the extension from the center of the gas inlet and the diffuser panel.

The opening area is set so as to increase in proportion to the distance from the gas inlet. Thereby, it is possible to supply the activation gas more uniformly to the surface of the electron source substrate, Following the forming process, the activation process is performed. Valves 25*a* and 25*b* for supplying gas and a valve 25*e* at the gas inlet side shown in FIG. 3 are opened and an organic substance gas 21 is introduced into a vacuum container 12. Benzonitrile is used as the organic substance gas 21, and the degree of opening of the valve 25*e* is adjusted while monitoring the pressure measured by a vacuum gauge 27*a* at the gas inlet side so that the pressure is $4\times10^{-4}$ Pa ($3\times10^{-6}$ Torr).

In this embodiment, the introduction and exhaust of the activation gas are regulated so that the amount of the reduction in the partial pressure during activation is limited to 20% or less.

It is possible to limit the amount of the reduction in the average partial pressure to 20% or less and to limit the range of partial pressure distribution to 20% or less for the activation gas in the vacuum container 12, by setting the conditions so as to satisfy the relationship $1/(4/C_x-1/C_z)\geqq S_{out}\geqq 4S_{act}-C_{in}$, where, as shown in FIG. 10, $S_{out}$ is the effective exhaust rate which corresponds to the combined conductance of the exhaust side conductance of the manufacturing apparatus and the exhaust rate of the pump, $S_{act}$ is the consumption rate of the activation gas during activation, $C_{in}$ is the conductance from the gas inlet to the position of the substrate nearest to the gas inlet, $C_x$ is the conductance from the position of the substrate nearest to the gas inlet to the position of the substrate nearest to the gas outlet, and $C_z$ is the conductance from the substrate to the gas outlet.

Research by the present inventors shows that under the conditions of this embodiment, the consumption rate $S_{act}$ of the activation gas is approximately 0.4 l/s. In the manufacturing apparatus used in this embodiment, the inlet side conductance $C_{in}$ is approximately 1 l/s. In consideration of the conditions described above, the effective exhaust rate at the exhaust side is set at 0.6 l/s, the same as the first embodiment.

In this embodiment, since the diffuser panel 19 provided with the openings 33 is disposed in the vacuum container 12, the activation gas partial pressure is more uniform in the vicinity of the electron source substrate 10.

In this embodiment, carbon films 29 interposed by the gap 5 are also formed on the electron-emitting element when the activation process is completed. In this embodiment, the activation process can be performed with superior uniformity compared to the first embodiment.

THIRD EMBODIMENT

In this embodiment, an electron source is manufactured in the same manner as in the second embodiment except the activation process is performed on two lines simultaneously among ten lines, instead of one by one.

Following the forming process, the activation process is performed. The valves 25*a* and 25*b* for supplying gas and the valve 25*e* at the gas inlet 15 side shown in FIG. 3 are opened and an organic substance gas 21 is introduced into the vacuum container 12. Benzonitrile is used as the organic substance gas 21, and the degree of opening of the valve 25*e* is adjusted while monitoring the pressure measured by the vacuum gauge 27*a* at the gas inlet side so that the pressure is $4\times10^{-4}$ Pa ($3\times10^{-6}$ Torr).

In this embodiment, the introduction and exhaust of the activation gas are performed under the conditions described below so that the amount of the reduction in the partial pressure and the range of partial pressure distribution during activation are limited to 20% or less.

When the number of elements to which the step of forming the carbon film is performed simultaneously is set to n, the relationship shown in the first embodiment is revised to $1/(4/C_x-1/C_z)\geqq S_{out}\geqq 4\cdot n\cdot S_{act1}-C_{in}$, where $S_{out}$ is the effective exhaust rate which corresponds to the combined conductance of the exhaust side conductance of the manufacturing apparatus and the exhaust rate of the pump, $C_{in}$ is the conductance from the gas inlet to the position of the substrate nearest to the gas inlet, $C_x$ is the conductance from the position of the substrate nearest to the gas inlet to the position of the substrate nearest to the gas outlet, $C_z$ is the conductance from the substrate to the gas outlet, and $S_{act1}$ is the consumption rate of the activation gas for its each element. Therefore, although the consumption rate of the activation gas is set at $S_{act}$ during activation in the first embodiment (in which ten lines are selected and a pulsed voltage of 1 ms is applied to them line by line), since the consumption rate in this embodiment is double the consumption rate in the first embodiment, if the relationship $1/(4/C_x-1/C_z)\geqq S_{out}\geqq 8S_{act}-C_{in}$ is satisfied, it is possible to limit the amount of the reduction in the average partial pressure of the activation gas and the range of partial pressure distribution to 20% or less.

Since the consumption rate increases as the number of simultaneously activated elements increases, in order to suppress the reduction in the partial pressure substantially to the same extent, the effective exhaust rate must be increased.

Research by the present inventors shows that the consumption rate $S_{act}$ of the activation gas is approximately 0.4 l/s under the conditions in the first embodiment. In the manufacturing apparatus used in this embodiment, the inlet side conductance $C_{in}$ is approximately 1 l/s. Therefore, by setting the effective exhaust rate at the exhaust side at 2.2 l/s or more, the amount of the reduction in the partial pressure of the activation gas is limited to 20% or less. In this embodiment, the effective exhaust rate at the exhaust side is set at 2.2 l/s.

Figure 5:
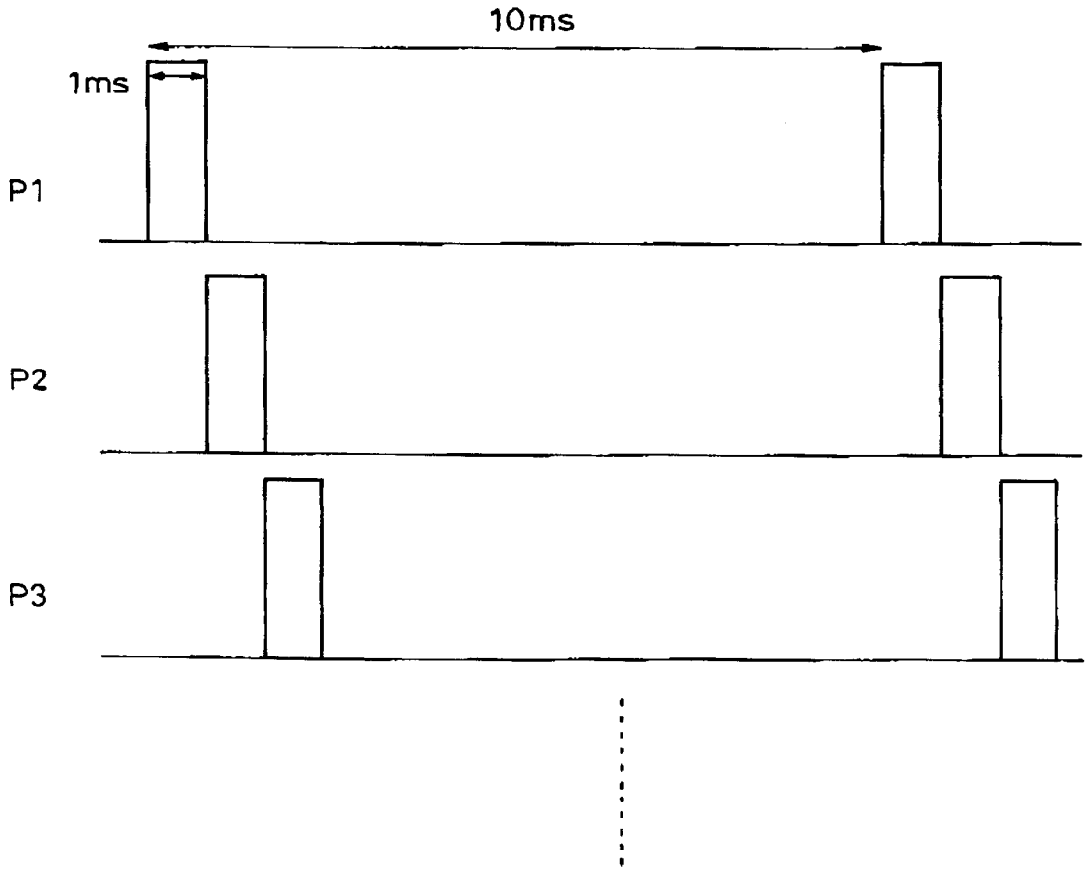
FIG. 5 is a schematic diagram showing the relationship among pulses applied to an electron source in the activation process in the present invention.

After the organic substance gas is introduced into the container, the activation process is performed by applying a voltage between the electrodes 2 and 3 of the individual electron-emitting elements 6 through the X-direction lines 7 and the Y-direction lines 8 using the driver 32. The voltage is controlled so that it increases from 10 V to 17 V, and the activation period is set to 30 minutes. Additionally, all the Y-direction lines 8 and unselected X-direction lines 7 are commonly connected to a Gnd (ground potential), X-direction lines 7 are selected and a pulsed voltage is applied sequentially to two lines simultaneously as shown in FIG. 5. By repeating the above method, the activation process is performed for all the X-direction lines 7.

As a result of the gas analysis at the gas outlet 16 side using a mass spectrometer with a differential pumping device (not shown in the drawing) during the activation process, it has been found that, as the gas is introduced, the mass No. 103 of benzonitrile is increased and saturated, and the decrease in the value during the activation process is 20% or less, the same as the first embodiment. Since the effective exhaust rate is increased in accordance with the number of simultaneously activated elements, although the number of elements activated simultaneously is double the number in the first embodiment, the reduction in the partial pressure during activation is considered to be limited to 20% or less.

In this embodiment, since the number of simultaneously activated elements is doubled, the activation period is half that of the first embodiment. It is possible to further decrease the period required for activation by increasing the number of elements activated simultaneously as well as by increasing the exhaust rate in the same manner as that described above.

FOURTH EMBODIMENT

In this embodiment, an electron source is manufactured in the same manner as that in the third embodiment apart from the fact that the activation process is performed simultaneously on two lines which are apart from each other by the total number of lines/2.

Following the forming process, the activation process is performed. The valves 25*a* and 25*b* for supplying gas and the valve 25*e* at the gas inlet 15 side shown in FIG. 3 are opened and an organic substance gas 21 is introduced into the vacuum container 12. Benzonitrile is used as the organic substance gas 21, and the degree of opening of the valve 25*e* is adjusted while monitoring the pressure measured by the vacuum gauge 27*a* at the gas inlet side so that the pressure is $4\times10^{-4}$ Pa ($3\times10^{-6}$ Torr).

In this embodiment, the introduction and exhaust of the activation gas are performed under the conditions described below so that the amount of the reduction in the partial pressure and the range of partial pressure distribution during activation are limited to 20% or less.

In this embodiment, the consumption rate of the activation gas is double the consumption rate in the first embodiment. It is possible to limit the amount of the reduction in the average partial pressure to 20% or less and to limit the range of partial pressure distribution to 20% or less for the activation gas in the vacuum container 12, by setting the conditions so as to satisfy the relationship $1/(4/C_x-1/C_z)\geqq S_{out}\geqq 8S_{act}-C_{in}$, where, as shown in FIG. 10, $S_{out}$ is the effective exhaust rate which corresponds to the combined conductance of the exhaust side conductance of the manufacturing apparatus and the exhaust rate of the pump, $C_{in}$ is the conductance from the gas inlet to the position of the substrate nearest to the gas inlet, $C_x$ is the conductance from the position of the substrate nearest to the gas inlet to the position of the substrate nearest to the gas outlet, $C_z$ is the conductance from the substrate to the gas outlet, and $S_{act}$ is the consumption rate of the activation gas in the activation process in the first embodiment (ten lines are selected each time, to which a pulsed voltage is applied line by line). Since the consumption rate increases as the number of simultaneously activated elements increases, in order to suppress the reduction in the partial pressure substantially to the same extent, the effective exhaust rate must be increased.

In this embodiment, the same as the first embodiment, the amount of the reduction in the partial pressure and the range of partial pressure distribution of the activation gas are limited to 20% or less.

Research by the present inventors shows that the consumption rate $S_{act}$ of the activation gas is approximately 0.4 l/s under the conditions in the first embodiment. In the manufacturing apparatus used in this embodiment, the inlet side conductance $C_{in}$ is approximately 1 l/s. Therefore, by setting the effective exhaust rate at the exhaust side at 2.2 l/s or more, the amount of the reduction in the partial pressure of the activation gas is limited to 20% or less. In this embodiment, the effective exhaust rate at the exhaust side is set at 2.2 l/s, the same as the third embodiment.

Figure 4:
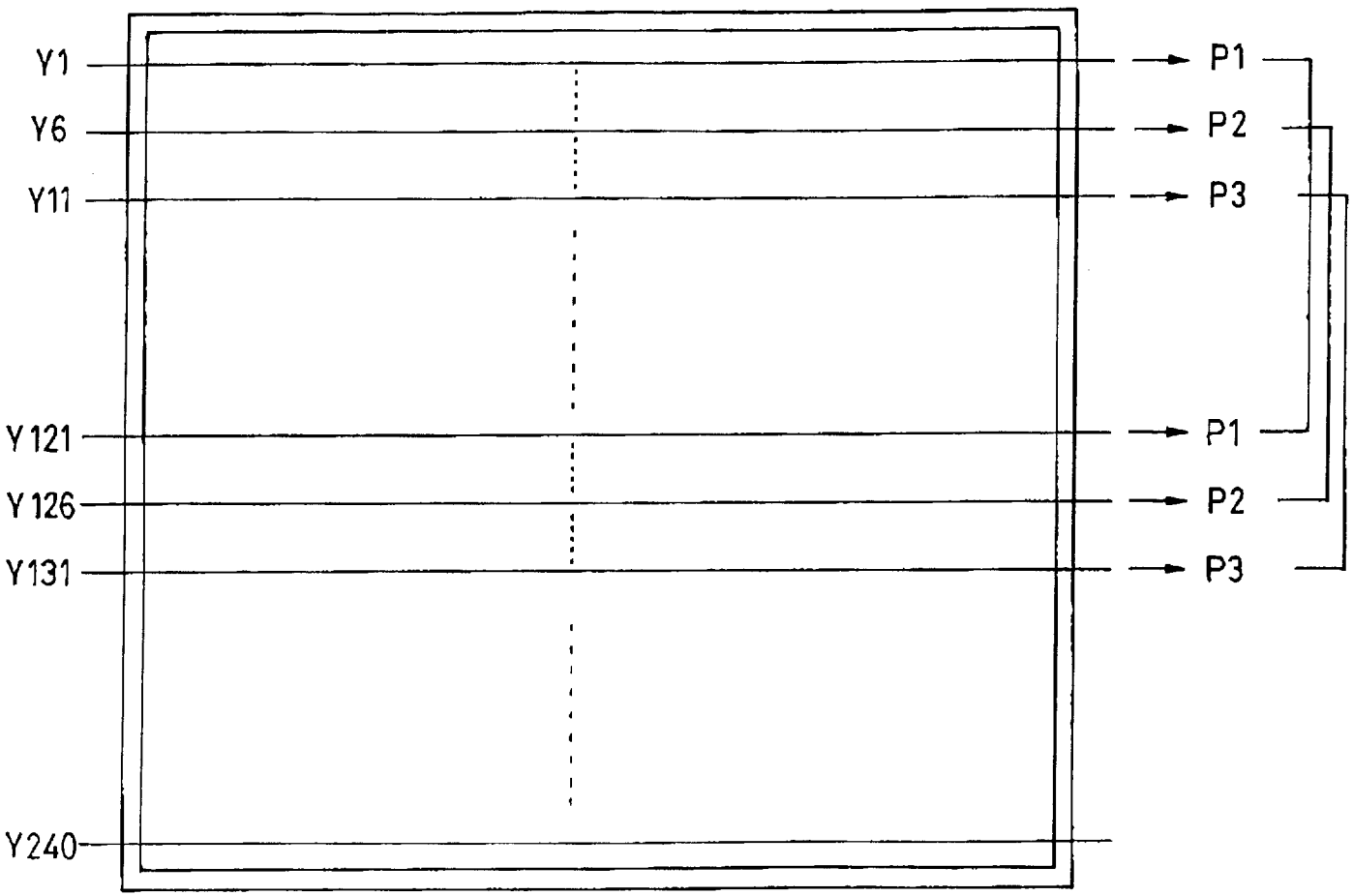
FIG. 4 is a schematic diagram showing a method for applying voltages to an electron source in the activation process in a fourth embodiment of the present invention.

After approximately 30 minutes from the start of the introduction of the organic substance gas, the activation process is performed by applying a voltage between the electrodes 2 and 3 of the individual electron-emitting elements 6 through the X-direction lines 7 and the Y-direction lines 8 using the driver 32. The voltage is controlled so that it increases from 10 V to 17 V, and the activation period is set to 30 minutes. Additionally, all the Y-direction lines 8 and unselected X-direction lines 7 are commonly connected to a Gnd (ground potential), twenty X-direction lines 7 are selected as shown in FIG. 4, and a pulsed voltage of 1 ms is applied in sequence to two lines simultaneously. By repeating the above method, the activation process is performed for all the X-direction lines 7.

As a result of the gas analysis at the gas outlet 16 side using a mass spectrometer with a differential pumping device (not shown in the drawing) in the activation process, it has been found that, as the gas is introduced, the mass No. 103 of benzonitrile is increased and saturated, and the decrease in the value in the activation process is 20% or less, the same as the first embodiment. Since the effective exhaust rate is increased in accordance with the number of simultaneously activated elements, although the number of elements activated simultaneously is double the number in the first embodiment, the reduction in the partial pressure during activation is considered to be limited to 20% or less.

In this embodiment, since the number of elements activated simultaneously is double the number in the first embodiment, the activation period is one half of the activation period in the first embodiment, i.e., 6 hours. Moreover, the lines through which the activation process is performed simultaneously are separated by the total number of lines/2, variations are further decreased than those in the third embodiment.

It is possible to further decrease the time required for activation by increasing the number of elements activated simultaneously as well as by increasing the exhaust rate in the same manner as that described above.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for manufacturing an electron source comprising an electron-emitting element having a first electrode, a second electrode, and a carbon film disposed between the first electrode and the second electrode, the electron-emitting element being placed on a front surface of a substrate, the method comprising the steps of:

covering a partial front surface or a entire front surface of the substrate provided with the first electrode and the second electrode by a container;

introducing a gas comprising a carbon compound into the container via a gas inlet of the container; and forming the carbon film by applying a voltage between the first electrode and the second electrode, wherein a relationship $1/(4/C_x-1/C_z)\geqq S_{out}\geqq 4S_{act}-C_{in}$ is satisfied, where $C_{in}$ is the conductance from the gas inlet to the position of the substrate nearest to the gas inlet, $C_x$ is a conductance from the position of the substrate nearest to the gas inlet to a position of the substrate nearest to a gas outlet for evacuating the container, $S_{out}$ is an effective exhaust rate of an exhaust unit connected to the gas outlet, $S_{act}$ is the consumption rate of a gas consumed by applying the voltage to the electron-emitting element, and $C_z$ is a conductance from the substrate to the gas outlet.

2. A method for manufacturing an electron source according to claim 1, wherein the electron source comprises a plurality of electron-emitting elements, and the relationship $1(4/C_x-1/C_z)\geqq S_{out}\geqq 4\cdot n\cdot S_{act1}-C_{in}$ is satisfied, where $S_{act1}$ is a consumption rate of the gas for each element, and n is a number of elements simultaneously subjected to the step of forming the carbon film.

3. A method for manufacturing an electron source according to claim 1, wherein the electron source comprises a plurality of electron-emitting elements, a plurality of X-direction lines for commonly connecting a plurality of first electrodes, and a plurality of Y-direction lines for commonly connecting a plurality of second electrodes, and in the step of forming the carbon film, the voltage is applied between each first electrode and each second electrode through the X-direction line and/or the Y-direction line.

4. A method for manufacturing an electron source according to claim 3, wherein, in the step of forming the carbon film, the carbon film is simultaneously formed on the elements connected to some of the X-direction lines adjacent to each other.

5. A method for manufacturing an electron source according to claim 3, wherein, in the step of forming the carbon film, the carbon film is simultaneously formed on the elements connected to some of the X-direction lines nonadjacent to each other.

6. A method for manufacturing an image-forming apparatus, the image forming apparatus comprising:

an electron source comprising an electron-emitting element having a first electrode, a second electrode, and a carbon film disposed between the first electrode and the second electrode, the electron-emitting element being placed on a front surface of a substrate; and an image-forming member facing the electron source and forming an image by electrons emitted from the electron-emitting element, the method comprises the steps of:

covering a partial front surface or a entire front surface of the substrate provided with the first electrode and the second electrode by a container;

introducing a gas comprising a carbon compound into the container via a gas inlet of the container; and forming the carbon film by applying a voltage between the first electrode and the second electrode, wherein a relationship $1/(4/C_x-1/C_z)\geqq S_{out}\geqq 4S_{act}-C_{in}$ is satisfied, where $C_{in}$ is a conductance from the gas inlet to a position of the substrate nearest to the gas inlet, $C_x$ is an conductance from the position of the substrate nearest to the gas inlet to a position of the substrate nearest to a gas outlet for evacuating the container, $S_{out}$ is an effective exhaust rate of an exhaust unit connected to the gas outlet, $S_{act}$ is a consumption rate of the gas consumed by applying the voltage to the electron-emitting element, and $C_z$ is a conductance from the substrate to the gas outlet.

7. A method for manufacturing an image-forming apparatus according to claim 6, wherein the electron source comprises a plurality of electron-emitting elements, and the relationship $1/(4/C_x-1/C_z)\geqq S_{out}\geqq 4\cdot n\cdot S_{act1}-C_{in}$ is satisfied, where $S_{act1}$ is a consumption rate of the gas for each element, and n is a number of elements simultaneously subjected to the step of forming the carbon film.

8. A method for manufacturing an image-forming apparatus according to claim 6, wherein the electron source comprises a plurality of electron-emitting elements, a plurality of X-direction lines for commonly connecting a plurality of first electrodes, and a plurality of Y-direction lines for commonly connecting a plurality of second electrodes, and in the step of forming the carbon film, the voltage is applied between each first electrode and each second electrode through the X-direction line and/or the Y-direction line.

9. A method for manufacturing an image-forming apparatus according to claim 8, wherein, in the step of forming the carbon film, the carbon film is simultaneously formed on the elements connected to some of the X-direction lines adjacent to each other.

10. A method for manufacturing an image-forming apparatus according to claim 8, wherein, in the step of forming the carbon film, the carbon film is simultaneously formed on the elements connected to some of the X-direction lines nonadjacent to each other.

11. An apparatus for manufacturing an electron source, the electron source comprising:

an electron-emitting element having a first electrode, a second electrode and a carbon film disposed between the first electrode and the second electrode, the electron-emitting element being placed on a front surface of a substrate, the apparatus comprising:

a base for supporting the substrate preliminarily provided with the first electrode and the second electrode;

a container for covering the front surface of the substrate supported by the base; and a voltage-applying unit, wherein, in the steps of covering a partial front surface or a entire front surface of the substrate provided with the first electrode and the second electrode by the container; introducing a gas comprising a carbon compound into the container via a gas inlet of the container; and forming the carbon film by applying a voltage between the first electrode and the second electrode using the voltage-applying unit, a relationship $1/(4/C_x-1/C_z)\geqq S_{out}\geqq 4S_{act}-C_{in}$ is satisfied, where $C_{in}$ is a conductance from the gas inlet to a position of the substrate nearest to the gas inlet, $C_x$ is a conductance from the position of the substrate nearest to the gas inlet to a position of the substrate nearest to a gas outlet for evacuating the container, $S_{out}$ is an effective exhaust rate of an exhaust unit connected to the gas outlet, $S_{act}$ is a consumption rate of the gas consumed by applying the voltage to the electron-emitting element, and $C_z$ is a conductance from the substrate to the gas outlet.

12. An apparatus for manufacturing an electron source according to claim 11, wherein the electron source comprises a plurality of electron-emitting elements, and the relationship $1/(4/C_x-1/C_z)\geqq S_{out}\geqq 4\cdot n\cdot S_{act1}-C_{in}$ is satisfied, where $S_{act1}$ is a consumption rate of the gas for each element, and n is a number of elements simultaneously subjected to the step of forming the carbon film.

13. An apparatus for manufacturing an electron source according to claim 11, wherein the electron source comprises a plurality of electron-emitting elements, a plurality of X-direction lines for commonly connecting a plurality of first electrodes, and a plurality of Y-direction lines for commonly connecting a plurality of second electrodes, and in the step of forming the carbon film, the voltage is applied between each first electrode and each second electrode through the X-direction line and/or the Y-direction line.

14. An apparatus for manufacturing an electron source according to claim 13, wherein, in the step of forming the carbon film, the carbon film is simultaneously formed on the elements connected to some of the X-direction lines adjacent to each other.

15. An apparatus for manufacturing an electron source according to claim 13, wherein, in the step of forming the carbon film, the carbon film is simultaneously formed on the elements connected to some of the X-direction lines non-adjacent to each other.

* * * * *

UNITED STATES PATENT AND TRADEMARK OFFICE

CERTIFICATE OF CORRECTION

PATENT NO. : 6,626,718 B2
DATED : September 30, 2003
INVENTOR(S) : Tamayo Hiroki It is certified that error appears in the above-identified patent and that said Letters Patent is hereby corrected as shown below:

Column 1,
Line 41, “apparatusis” should read -- apparatus is --.

Column 2,
Line 19, “sections” should read -- sections. --.

Column 6,
Line 26, “container.” should read -- container, --.

Column 10,
Line 40, “used” should read -- used. --.

Column 11,
Line 7, “substrate,” should read -- substrate. --.

Column 14,
Line 54, “a” (second occurrence) should read -- an --.

Column 15,
Line 3, “the” (second occurrence) should read -- a --;
Line 34, “image forming” should read -- imaging-forming --;
Line 46, “a” (second occurrence) should read -- an --; and
Line 57, “an” should read -- a --.

Column 16,
Line 43, “a” should read -- an --.

Signed and Sealed this

Twenty-second Day of June, 2004

JON W. DUDAS
*Acting Director of the United States Patent and Trademark Office*